US006712714B2

(12) United States Patent
Joswick

(10) Patent No.: US 6,712,714 B2
(45) **Date of Patent: *Mar. 30, 2004**

(54) GOLF COURSE HOLE CUP ADVERTISING METHOD

(76) Inventor: Jason J. Joswick, 1477 Enchante Way, Oceanside, CA (US) 92056

( * ) Notice: Subject to any disclaimer, the term of this patent is extended or adjusted under 35 U.S.C. 154(b) by 0 days.

This patent is subject to a terminal disclaimer.

(21) Appl. No.: 10/166,556

(22) Filed: Jun. 10, 2002

(65) Prior Publication Data

US 2003/0228923 A1 Dec. 11, 2003

(51) Int. Cl.[7] ..... A63B 57/00
(52) U.S. Cl. ..... 473/175
(58) Field of Search ..... 473/175, 176, 473/177–179

(56) References Cited

U.S. PATENT DOCUMENTS 4,878,665 A * 11/1989 Boudreau et al. ..... 473/175
5,190,283 A * 3/1993 Hannon ..... 473/176
5,249,384 A * 10/1993 Dark, Jr. ..... 40/660
5,362,044 A * 11/1994 Hageman ..... 473/175
5,588,918 A 12/1996 Eckman et al. ..... 473/187
5,674,131 A 10/1997 Forbes et al. ..... 473/177
5,788,581 A * 8/1998 Mabie ..... 473/175
D411,601 S 6/1999 Fong ..... D21/791
5,964,667 A 10/1999 Brookman ..... 473/176
6,110,053 A 8/2000 Sjoblom ..... 473/179
6,283,873 B1 9/2001 Nunes ..... 473/180

* cited by examiner

*Primary Examiner*—Mark S. Graham
(74) *Attorney, Agent, or Firm*—Procopio, Cory, Hargreaves & Savitch, LLP

(57) ABSTRACT

A method of using a golf cup advertising device includes providing a golf course hole cup advertising device including a removable annular advertising member having viewable advertising; and inserting the removable annular advertising member into a golf course hole cup. The golf course hole cup includes a central cylinder with a central hole to receive a pin and an inner ring and an outer ring separated by multiple holes having a substantially arcuate outer portion. The removable annular advertising member is sized so that the entire substantially arcuate outer portion of all the holes is exposed when the golf course hole cup advertising device is within the golf course hole cup.

15 Claims, 2 Drawing Sheets

GOLF COURSE HOLE CUP ADVERTISING METHOD

FIELD OF THE INVENTION

The present invention is in the field of golf course hole cup advertising.

BACKGROUND OF THE INVENTION

A golf course hole cup is a plastic cylindrical cup that is placed in a hole made on a golf green. It is the general object of golf to hit a golf ball with a variety of golf clubs from a tee box to the golf hole cup in as few shots as possible.

U.S. Pat. No. 6,283,873 to Nunes describes a ramped practice putting cup that may include advertising for promotional purposes. A problem with this ramped practice putting cup include that it is not useable with a golf hole cup of a golf course because the practice putting cup is not configured to be used in a golf hole cup and United States Golf Association rules prohibit the use of practice devices on a golf course during play. Further, the advertising described in the Nunes patent is designed to be seen by a single user during practice, not multiple different golfers on a golf course.

U.S. Pat. No. 5,788,581 to Mable describes an image display device and method that allows an advertisement or message to be displayed within a golf cup. A problem with this image display device is that it includes a square configuration with corners that extend all the way to the inner circular edge of the cup. The corners provide flow channels for rain, ground run-off, or other water flow across the upper surface of the device. Because this water is directed to a flag pin hole in the center of the device and the flag pin is often in the hole during wet conditions, improper drainage and pooling on the upper surface can occur. As a result of the improper drainage, damage can occur to the advertising insert, or dirt and debris can collect on the upper surface, preventing the advertisement from being effectively viewed. Another problem with the rectangular nature of this device is that a golfer has to approach the hole from a specific direction to easily read the advertising. Because a golf hole is cylindrical and a golfer may approach the hole from any direction (360 degrees), golfers retrieving a golf ball from the hole that do not approach the hole in a direction squarely with the advertising will have a hard time reading the advertising on the rectangular advertising device. A further problem with the device is that it is readily removable from the cup. As a result, golfers, children, or other mischievous individuals looking for a free souvenir are likely to remove the devices from the cups.

SUMMARY OF THE INVENTION

Accordingly, an aspect of the invention involves a method of using a golf cup advertising device with a golf course hole cup including a central cylinder with a central hole to receive a pin. The method includes the steps of providing a golf course hole cup advertising device including a substantially funnel-shaped base having an annular flange and a projection member extending downwardly from the annular flange to be received by the central hole of the cup and including a retaining mechanism to prevent the golf cup advertising device from being readily removed from the cup, a replaceable annular advertising insert disposed on the annular flange of the base, the annular advertising insert including a top and a bottom, at least the top including advertising, and a removable annular transparent cover disposed on the annular advertising insert that allows the advertising on the top of the annular advertising insert to be viewed by an observer looking into the cup and is removable to allow the replaceable annular advertising insert to be replaced; and inserting the golf course hole cup advertising device into a golf course hole cup by inserting the projection member into the central cylinder; and using the retaining mechanism to retain the substantially funnel-shaped base to the central cylinder to prevent the golf cup advertising device from being readily removed from the cup.

Another aspect of the invention involves a method of using a golf cup advertising device with a golf course hole cup including a central cylinder with a central hole to receive a pin, the cup including an inner ring and an outer ring separated by multiple holes having a substantially arcuate outer portion. The method includes the steps of providing a golf course hole cup advertising device including a removable annular advertising member having viewable advertising, the removable annular advertising member sized so that the entire substantially arcuate outer portion of all the holes is exposed when the golf course hole cup advertising device is within the golf course hole cup; and inserting the removable annular advertising member into a golf course hole cup so that the entire substantially arcuate outer portion of all the holes is exposed and the advertising is viewable to an observer looking into the cup.

A further aspect of the invention involves a method of using a golf cup advertising device with a golf course cup of a golf course hole. The method includes the steps of providing a golf course hole cup advertising device including viewable advertising and a retaining mechanism to retain the golf course hole cup advertising device within the cup; inserting the golf course hole cup advertising device into a golf course cup; retaining the golf course hole cup advertising device within the golf course cup with the retaining mechanism so that the golf course hole cup advertising device is not readily removable from the golf course cup; using an instrument to disengage the retaining mechanism while the golf course cup is in the golf course hole; and removing the golf course hole cup advertising device from the golf course cup.

Further objects and advantages will be apparent to those skilled in the art after a review of the drawings and the detailed description of the preferred embodiments set forth below.

DETAILED DESCRIPTION OF PREFERRED EMBODIMENTS

With reference to FIGS. 1A–3B, an embodiment of a golf cup advertising device 10 for use with a golf cup 20 of a golf course hole will now be described.

Figure 1A:
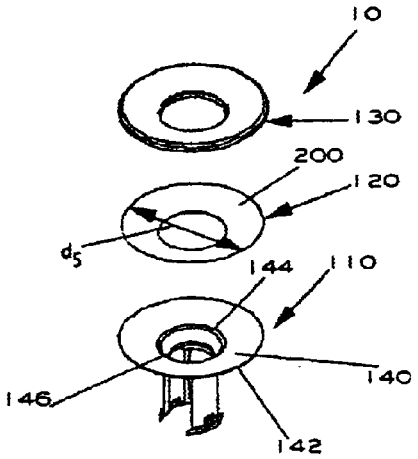
FIG. 1A is an exploded top perspective view of an embodiment of a golf cup advertising device and a golf cup.
Figure 1A:
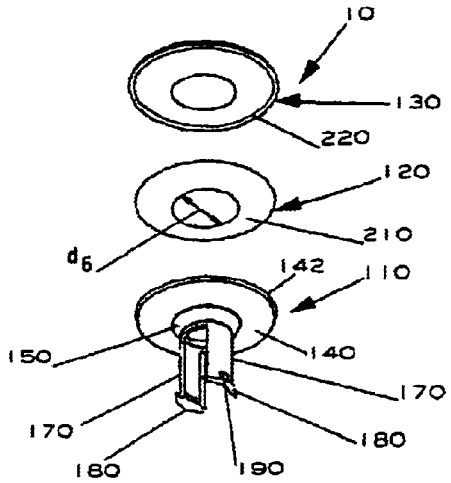
Figure 1A:
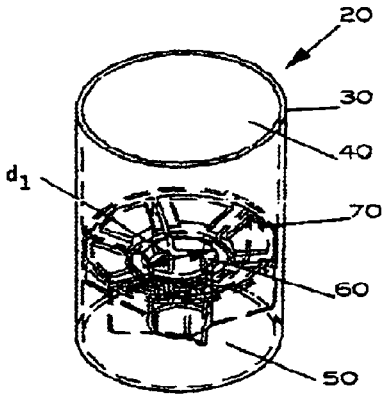
Figure 1B:
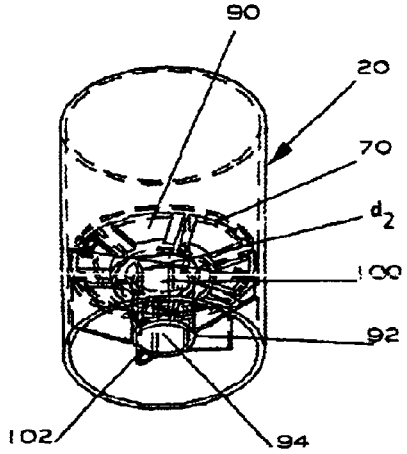
FIG. 1B is an exploded bottom perspective view of the golf cup advertising device and the golf cup illustrated in FIG. 1A.
Figure 2A:
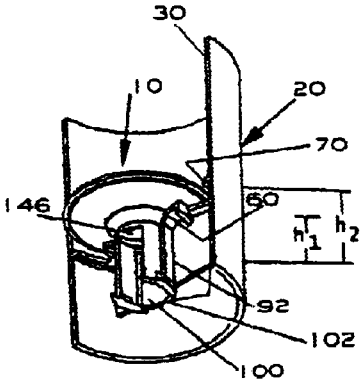
FIG. 2A is a bottom perspective view of the golf cup advertising device illustrated in FIG. 1A shown in an assembled condition in a partially cut-away golf cup.
Figure 2B:
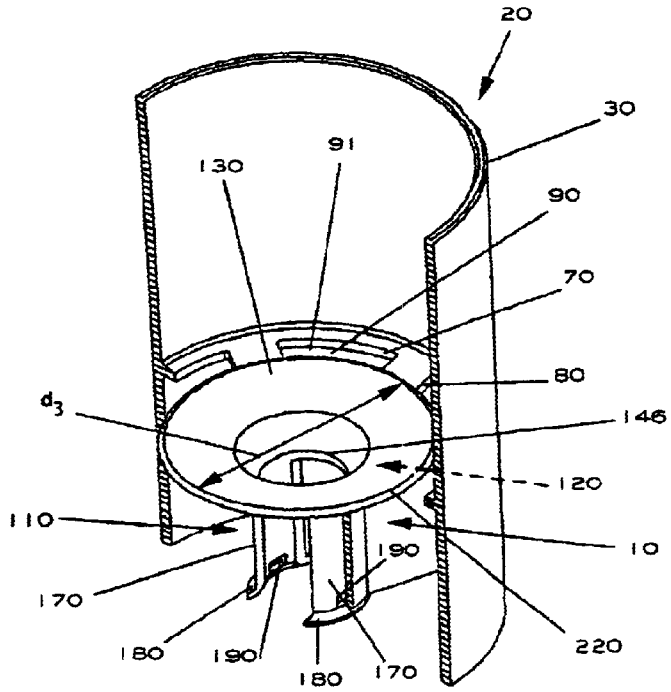
FIG. 2B is a top perspective view of the golf cup advertising device illustrated in FIG. 2B.
Figure 3A:
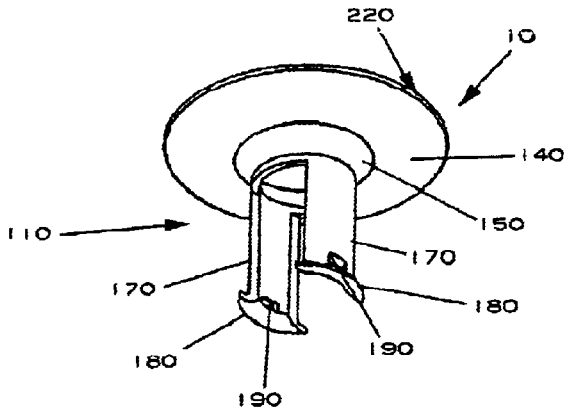
FIG. 3A is a bottom perspective view of the golf cup advertising device illustrated in FIG. 1A shown in an assembled condition.
Figure 3B:
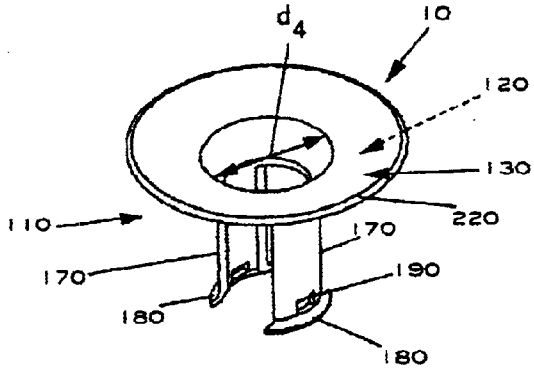
FIG. 3B is a top perspective view of the golf cup advertising device illustrated in FIG. 3A.

Before describing an embodiment of the golf cup advertising device 10 of the present invention, the golf cup 20 will be described in more detail. The golf cup 20 includes a plastic cylindrical wall 30 with an open circular top 40 and open circular bottom 50. In a lower half of the golf cup 20, the golf cup 20 includes a support area for supporting a golf ball putted into the cup and the pin. The support area includes an inner ring 60 having an internal diameter $d_1$ and located at a first height $h_1$ from the bottom 50 of the cup 20. An outer ring 70 has an internal diameter $d_2$ greater than the internal diameter $d_1$ of the inner ring 60 and is located at a second height $h_2$ from the bottom 50 of the cup 20 that is greater than the first height $h_1$. Connecting members 80 radiate at an angle upwardly from the inner ring 60 in a sunburst pattern and connect the inner ring 60 and outer ring 70. Generally trapezoidal holes 90 are formed between the inner ring 60, outer ring 70, and connecting members 80. As illustrated in FIG. 2B, with the device 10 in place within the cup 20, the entire arc of at least an outer portion 91 of the holes 90 is exposed. This facilitates water drainage through the outer portion 91 of the holes 90, and makes it easier to grab the cover 130 to remove the cover 130 or grab the device 10 to remove the device 10. A central cylinder 92 extends downwardly from the inner ring 60 and includes an interior wall 94 that forms a central bore or hole 100. The central cylinder 92 terminates in an annular bottom edge 102.

The golf cup advertising device 10 will now be described. The golf cup advertising device 10 is preferably a substantially funnel-shaped annual advertising member. The device 10 includes a substantially funnel-shaped annular base 110, an annular advertising insert 120, and an annular transparent cover 130.

The base 110 is preferably injection molded out of plastic and includes a slightly concave annular flange 140. The annular flange 140 includes an outer circumferential edge 142 and an inner circumferential edge 144. The inner circumferential edge 144 defines a central hole 146 that is coaxial with the central bore 100 of the cup 20 when the device 10 is positioned in the cup 20. The annular flange 140 has an outer diameter $d_3$ and an inner diameter $d_4$. The outer diameter $d_3$ is greater than the internal diameter $d_2$ of the outer ring 70 and both the outer diameter $d_3$ and the inner diameter $d_4$ are greater than the internal diameter $d_1$ of the inner ring 60. An annular intermediate section 150 extends downwardly from the inner circumferential edge 144 of the annular flange 140 and is more concave than the annular flange 140. A pair of opposite resilient, incurved legs 170 extend downwardly from the intermediate section 150. The legs 170 terminate at distal ends in outwardly extending, curved ledges 180. Centered directly above the ledges 180 are generally rectangular windows 190.

The annular advertising insert 120 is disposed on top of the annular flange 140 and has substantially the same configuration as the annular flange 140 except that the insert 120 has an outer diameter $d_5$ that is slightly smaller than the outer diameter $d_3$ of the annular flange 140 and an inner diameter $d_6$ that is slightly greater than the inner diameter $d_4$ of the annular flange 140. The annular advertising insert 120 may be made of any material, e.g., paper, plastic, cardboard, that may receive and display advertising. The insert 120 includes a top 200 and a bottom 210. Advertising (e.g., trademarks, service marks, tradenames, slogans, logos, specials, offers, etc.) is located on at least the top 200 and may be located on the top 200 and the bottom 210. A single advertisement or multiple advertisements may be located on the top 200 and/or bottom 210. If advertising is located on the top 200 and the bottom 210, changing the advertising at the golf course hole may be as simple as removing the transparent cover 130, flipping the advertising insert 120 over, and replacing the annular transparent plastic cover 130.

The annular transparent plastic cover 130 covers the annular advertising insert 120 and the annular flange 140. The annular transparent plastic cover 130 has substantially the same configuration as the annular flange 140, the annular advertising to insert 120, and the annular flange 140, except the cover 130 may include a circular, downwardly extending lip 220 at its outer circumference that may fit snugly over the outer edge of the annular flange 140 for securing the cover 130 to the annular flange 140 (over the advertising insert 120).

It should be noted, the outer diameters of the annular flange 140 of the base 110, the advertising insert 120, and the transparent cover 130 are sized so that around the periphery of the device 10, the entire arc of at least an outer portion of the holes 90 is exposed. Exposing the entire arc of the outer portion of the holes 90 prevents flow channels for rain, ground run-off, or other water flow from forming across the upper surface of the device 10. This prevents pooling of water on the device 10, water damage from occurring to the advertising insert 120, and dirt and debris from collecting on the upper surface of the cover 130, allowing the advertising to be effectively viewed.

The golf cup advertising device 10 will now be described in use. The golf cup advertising device 10 is assembled by placing the advertising insert 120, bottom 210 facing down, on the annular flange 140 of the base 110. The transparent cover 130 is placed on top of the advertising insert 120 and the annular flange 140. The cover 130 may be secured to the annular flange 140 by pressing the circumferential lip 220 of the cover 130 over the outer edge 142 of the annular flange 140. With the cover 130 secured to the annular flange 140, advertising on the top 200 of the advertising insert 120 can be clearly seen when looking down at the cup 20.

Securing the golf cup advertising device 10 within the golf cup 20 is desirable to prevent the device from being removed from the golf cup 20 with the removal of the pin from the cup 20. Further, securing the golf cup advertising device 10 within the golf cup 20 is important for preventing golfers, children, or other mischievous individuals looking for a free souvenir from removing the device 10 from the cup 20.

To secure the golf cup advertising device 10 to the inside of the golf cup 20, the device 10 is inserted into the open circular top 40 of the golf cup 20 and the legs 170 of the base 110 are inserted through the central bore 100 of the central cylinder 92. The legs 170 may need to be pinched together to allow the ledges 180 extending outwardly from the legs 170 to clear the interior wall 94 of the central cylinder 92. When the legs 170 are fully inserted into the central bore 100 of the central cylinder 92 and the ledges 180 clear the bottom edge 102 of the central cylinder 92, the resilient nature of the legs 170 causes the legs 170 and the ledges 180 to snap outwardly so that ledges 180 are disposed beneath the bottom edge 102 of the central cylinder 92. The resilient legs 170 and the ledges 180 disposed beneath the bottom edge 102 of the central cylinder 92 serve as a retaining mechanism to prevent the golf cup advertising device 10 from being readily removed from the hole.

The golf cup advertising device 10 may be removed from the golf cup 20 with the golf cup 20 in or out of the hole. For example, the golf cup advertising device 10 may be removed from the golf cup 20 with the golf cup 20 out of the hole when the holes on the greens are being changed, which generally occurs 2–3 times a week. To remove the golf cup advertising device 10 from the golf cup 20 with the golf cup 20 out of the hole, the ledges 180 are pinched inward and the annular flange 140 of the base 110 is simultaneously pulled outwardly through the open circular top 40, to cause the golf cup advertising device 10 to be removed from the golf cup 20. To remove the golf cup advertising device 10 from the golf cup 20 with the golf cup 20 in the hole, a tweezer-like instrument may be inserted into the central hole 146 and opposite distal ends of the tweezer-like instrument are inserted outwardly through the windows 190 so that inside edges of the opposite distal ends of the tweezer-like instrument are against an outer surface of the legs 170 or an outer part of the ledges 180. The tweezer-like instrument is then squeezed together, causing the legs 170 to be urged inward, until the ledges 180 clear the bottom edge 102 of the central cylinder 92. Once the ledges 180 clear the bottom edge 102 of the central cylinder 92, the annular flange 140 of the base 110 is pulled outwardly through the open circular top 40, to cause the golf cup advertising device 10 to be removed from the golf cup 20. The opposite distal ends of the tweezer-like instrument may flair outward, have an outward step-shaped configuration, or similar configuration to facilitate inserting the opposite distal ends outwardly through the windows 190. It should be noted, the retaining mechanism formed by the resilient legs 170 and ledges 180 allows the device 10 to be easily removed by authorized individuals with the tweezer-like device, but prevents the device 10 from being readily removed from the golf cup 20 by golfers, children, or other mischievous individuals looking for a free souvenir.

Advertising may be easily changed with the golf cup advertising device 10 without having to remove the device 10 from the cup 20. To change advertising, the transparent cover 130 is removed from the annular flange 140 of the base 110. The old advertising insert 120 may be replaced with a new advertising insert 120. Alternatively, the new advertising insert 120 may be placed on top of the old advertising insert 120. If the insert 120 includes advertising on both the top 200 and the bottom 210, advertising may be changed by flipping the insert 120 over so that the new advertising is face up in the cup 20. Multiple advertising inserts 120 may be disposed between the cover 130 and the annular flange 140 so that advertising may be changed by switching advertising inserts 120 already available at the hole. This reduces the burden of having to constantly bring new advertising inserts 120 to the holes and reduces the chances of losing advertising inserts.

It should be noted, the golf cup advertising device 10 may be assembled before or after the base 110 is inserted into the cup 20. Further, the golf cup advertising device 10 or base 110 may be inserted into the cup 20 when the cup 20 is in or out of the golf green hole.

With the golf cup advertising device 10 positioned within the golf cup 10 of the hole, the bottom of the pin my be inserted though the central hole 146 of the device 10 and into the central bore 100 of the cup 20 so that the pin is retained within the hole. Thus, the golf cup advertising device 10 does not prevent the pin from being inserted into the cup 20.

When a golf ball is putted into the cup 20, the golf ball will sit within the central hole 146 of the base 110, with advertising being displayed with the insert 120 in a circular fashion around the golf ball. When the golfer looks and reaches into the cup 20 to recover the golf ball, the advertising will be prominently displayed to the golfer, regardless of the direction from which the golfer approaches the hole.

Although the golf cup advertising device 10 has been described as including a removable advertisement insert disposed between the base 110 and the cover 130, in an alternative embodiment, the golf cup advertising device 10 may have a single-piece construction. For example, the golf cup advertising device 10 may include a singular removable annular advertising member with advertising viewable to an observer looking into the cup 20. In this embodiment, for example, the advertising member may have an outer diameter $d_5$ that closely matches the inner diameter of the cylindrical wall 30 of the golf cup 20 so that the advertising member stays centered within the cup 20. The inner diameter $d_6$ may be sized to allow water to pass through the one or more of the holes 90, 100 and/or the advertising member may include one or more holes to prevent the cup 20 from flooding over.

The golf cup advertising device 10 may include just the base 110 without the insert 120 and cover 130. The upper surface of the annular flange 140 of the base 110 may include a sticker, a stamp, or other object including advertising.

The golf cup advertising device 10 and method of use allows the holes of a golf course to be used for advertising. This type of advertising is advantageous in that it reaches a large number of potential customers, the advertising can be focused because advertisers know that golfers will be viewing the advertising, and because golfer have to look into the holes to retrieve golf balls, advertisers are guaranteed to capture the attention of potential customers with advertising in the golf cup 20. The golf cup advertising device 10 and method of use are further advantageous in that they allow advertising to be easily changed, allow the pin to be inserted into and removed from the golf cup 20 in a normal fashion without accidentally displacing or removing the device 10 from the cup 20.

It will be readily apparent to those skilled in the art that still further changes and modifications in the actual concepts described herein can readily be made without departing from the spirit and scope of the invention as defined by the following claims.

What is claimed is:

1. A method of using a golf cup advertising device with a golf course hole cup including a central cylinder with a central hole to receive a pin and an inner ring and an outer ring separated by multiple holes having a substantially arcuate outer portion, the method comprising the steps of:

providing a golf course hole cup advertising device including a substantially funnel-shaped base having an annular flange sized so that the entire substantially arcuate outer portion of all the holes is exposed when the golf course hole cup advertising device is within the golf course hole cup and a projection member extending downwardly from the annular flange to be received by the central hole of the cup and including a retaining mechanism to prevent the golf cup advertising device from being readily removed from the cup, a replaceable annular advertising insert disposed on the annular flange of the base, the annular advertising insert including a top and a bottom, at least the top including advertising, and a removable annular transparent cover disposed on the annular advertising insert that allows the advertising on the top of the annular advertising insert to be viewed by an observer looking into the cup and is removable to allow the replaceable annular advertising insert to be replaced; and inserting the golf course hole cup advertising device into a golf course hole cup by inserting the projection member into the central cylinder; and using the retaining mechanism to retain the substantially funnel-shaped base to the central cylinder to prevent the golf cup advertising device from being readily removed from the cup.

2. The method of claim 1, wherein the central cylinder terminates in a bottom, the projection member includes a pair of resilient incurved legs extending downwardly from the annular flange and the retaining mechanism includes a pair of ledges that extend outwardly from the incurved legs to catch the bottom of the central cylinder of the cup to retain the base within the cup, and inserting the golf course hole cup advertising device into a golf course hole cup includes inserting the pair of resilient incurved legs through the central cylinder so that the resilient legs are urged inward until the ledges clear the bottom of the central cylinder and flex outward to catch the bottom of the central cylinder of the cup.

3. The method of claim 1, wherein the base includes all inner diameter sized to receive a pin.

4. The method of claim 1, further including removing the annular transparent cover, replacing the advertising of the replaceable annular advertising insert with replacement advertising, and covering the replacement advertising with the replacement cover.

5. The method of claim 4, wherein the replaceable annular advertising insert includes advertising on both the top and the bottom.

6. The method of claim 5, wherein replacing the advertising of the replaceable annular advertising insert with replacement advertising includes flipping the replaceable annular advertising insert over so that the advertising previously on the bottom is on the top.

7. The method of claim 4, wherein replacing the advertising of the replaceable annular advertising insert with replacement advertising includes replacing the replaceable annular advertising insert with a different replaceable annular advertising insert.

8. The method of claim 4, wherein the golf course hole cup advertising device includes multiple replaceable annular advertising inserts disposed between the annular transparent cover and the annular base, and replacing the advertising of the replaceable annular advertising insert with replacement advertising includes replacing the replaceable annular advertising insert with one of the other replaceable annular advertising inserts disposed between the annular transparent cover and the annular base.

9. The method of claim 1, wherein the replaceable annular advertising insert includes multiple advertisements on at least the top.

10. The method of claim 1, wherein the annular base includes an outer circumferential edge and the cover includes a circumferential downwardly extending lip that fits over the outer circumferential edge of the annular base to secure the cover to the annular base.

11. The method of claim 1, wherein the central cylinder terminates in a bottom, the projection member includes a pair of resilient incurved legs extending downwardly from the annular flange and the retaining mechanism includes a pair of ledges that extend outwardly from the incurved legs to catch the bottom of the central cylinder of the cup to retain the base within the cup, and further including removing the golf course hole cup advertising device from the cup by pinching the ledges and the resilient legs inward until the ledges clear the bottom of the central cylinder and pulling the golf course hole cup advertising device out of the cup.

12. The method of claim 11, wherein the golf course hole cup advertising device is removed from the cup with the cup in the golf hole and the ledges of the resilient legs are pinched inward using an instrument.

13. The method of claim 12 wherein the pair of resilient incurved legs include opposite windows located above the ledges, and the instrument is inserted outwardly through the windows to pinch the ledges of the resilient legs inward.

14. A method of using a golf cup advertising device with a golf course hole cup including a central cylinder with a central hole to receive a pin, the cup including an inner ring and an outer ring separated by multiple holes having a substantially arcuate outer portion, the method comprising the steps of:

providing a golf course hole cup advertising device including a substantially funnel-shaped base having an annular flange and a projection member extending downwardly from the annular flange to be received by the central hole of the cup, a replaceable annular advertising insert disposed on the annular flange of the base, the annular advertising insert including a top and a bottom, at least the top including advertising, and a removable annular transparent cover disposed on the annular advertising insert that allows the advertising on the top of the annular advertising insert to be viewed by an observer looking into the cup and is removable to allow the replaceable annular advertising insert to be replaced, the golf course hole cup advertising device sized so that the entire substantially arcuate outer portion of all the holes is exposed when the golf course hole cup advertising device is within the golf course hole cup; and inserting the golf course hole cup advertising device into a golf course hole cup so that the entire substantially arcuate outer portion of all the holes is exposed and the advertising is viewable to an observer looking into the cup.

15. A method of using a golf cup advertising device with a golf course cup of a golf course hole, the golf course cup including a central cylinder with a bottom, the method comprising the steps of:

providing a golf course hole cup advertising device including viewable advertising, a pair of resilient, downwardly extending, incurved legs, and a retaining mechanism including a pair of ledges that extend outwardly from the incurved legs to catch the bottom of the central cylinder of the cup to retain the golf course hole cup advertising device within the cup;

inserting the golf course hole cup advertising device into a golf course cup by inserting the pair of resilient incurved legs through the central cylinder so that the resilient legs are urged inward until the ledges clear the bottom of the central cylinder and flex outward to catch the bottom of the central cylinder of the cup;

retaining the golf course hole cup advertising device within the golf course cup with the retaining mechanism so that the golf course hole cup advertising device is not readily removable from the golf course cup;

using an instrument to disengage the retaining mechanism while the golf course cup is in the golf course hole;

removing the golf course hole cup advertising device from the golf course cup.

* * * * *